US006863919B1

(12) United States Patent
Mäenpääet al.

(10) Patent No.: US 6,863,919 B1
(45) Date of Patent: Mar. 8, 2005

(54) METHOD FOR CONTROLLING THE MOISTURE OF A WEB IN MACHINE DIRECTION ON A COATING MACHINE

(75) Inventors: Tapio Mäenpää, Helsinki (FI); Eero Suomi, Hämeenlinna (FI); Vilho Nissinen, Numminen (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/914,657

(22) PCT Filed: Mar. 2, 2000

(86) PCT No.: PCT/FI00/00166

§ 371 (c)(1),
(2), (4) Date: Sep. 24, 2001

(87) PCT Pub. No.: WO00/52265

PCT Pub. Date: Sep. 8, 2000

(30) Foreign Application Priority Data

Mar. 4, 1999 (FI) ..... 990474

(51) Int. Cl.[7] ..... B05D 3/02

(52) U.S. Cl. ..... 427/8; 427/382; 427/395; 427/444

(58) Field of Search ..... 427/8, 382, 395, 427/444; 118/712; 34/446

(56) References Cited

U.S. PATENT DOCUMENTS

| | | | | |
|---|---|---|---|---|
| 4,087,568 A | * | 5/1978 | Fay et al. | 427/8 |
| 4,202,112 A | | 5/1980 | Von der Eltz et al. | 34/4 |
| 4,498,864 A | | 2/1985 | Roth et al. | 432/28 |
| 4,701,857 A | | 10/1987 | Robinson | 364/477 |
| 5,377,428 A | | 1/1995 | Clark | 34/446 |
| 5,715,158 A | | 2/1998 | Chen | 364/150 |
| 5,718,060 A | | 2/1998 | Mori | 34/446 |
| 6,446,356 B1 | | 9/2002 | Hamström et al. | 34/451 |
| 6,490,813 B1 | | 12/2002 | Oechsle | 34/445 |

FOREIGN PATENT DOCUMENTS

| | | | | |
|---|---|---|---|---|
| DE | 37 41 128 | | 6/1988 | D21F/7/06 |
| DE | 39 01 378 | | 8/1989 | F26B/21/06 |
| WO | 98/41805 | * | 9/1998 | |

OTHER PUBLICATIONS

Derwent–Acc–No: 1998–496785—Abstract of WO 98/41805 (Sep. 24, 1998).*

* cited by examiner

*Primary Examiner*—Katherine Bareford
(74) *Attorney, Agent, or Firm*—Cohen, Pontani, Lieberman & Pavane

(57) ABSTRACT

The invention relates to a method by means of which the machine-direction moisture of a web being coated can be controlled in an optimal manner that takes into account moisture content changes along the entire path of the coating and drying process. Advantageously, all the dryers the coater section are controlled in an integrated manner in order to obtain a controlledly processed product which is optimized in regard to energy consumption and product quality. Each process section and unit contributing to the drying of the web is identified by means of a mathematical submodel describing the specific evaporation rate in the respective process section/unit and, by chaining these submodels, a composite model is compiled for the entire process, whereby the composite model makes it possible to manage the drying operation in the process so that the individual units are controlled as a portion of the overall process.

20 Claims, 5 Drawing Sheets

METHOD FOR CONTROLLING THE MOISTURE OF A WEB IN MACHINE DIRECTION ON A COATING MACHINE

PRIORITY CLAIM

This is a national stage application under 35 U.S.C. §371 of international stage PCT application No. PCT/FI00/00166, filed on Mar. 2, 2000. Priority is claimed under 35 U.S.C. §119(a) and 35 U.S.C. §365(b) from Finnish Patent Application No. 990474, which was filed in Finland on Mar. 4, 1999, and from which priority was properly claimed in the aforementioned international stage application.

FIELD OF THE INVENTION

The present invention relates to a method based on a novel control and steering strategy for use in the drying process of a paper web or similar coated web material such as a board in coater sections in which the web to be coated is passed via a coater station including at least one applicator apparatus and dryers.

BACKGROUND OF THE INVENTION

In the coating of a web of paper or board, the surface of the web is first coated with a furnish containing coating pigments slurried in water. After the application and smoothing of the coating mix, the coating applied to the web surface as well as the underlying base web must be dried to a sufficiently low moisture for final use or further processing. Hence, a major portion of the energy consumed in the production of coated paper grades is lost in drying the web during the different steps of postprocessing, which means that energy management in drying is an extremely vital factor contributing to the profitability of production. Correct drying technique also affects the quality of the produced paper grade. Another parameter highly pertinent to the quality of produced paper is the control of the machine-direction moisture profile, that is, the moisture of the base paper, which must be kept at a constant level during the run. The web moisture content affects particularly the paper web behavior in calendering and printing. As modern production lines are equipped with on-line calendering, wherein the coated web is passed directly to a calender, the moisture profile of the running web has an insufficient time to reach a uniform equilibrium state prior to calendering, a situation which is in contrast to that attainable in the traditional off-line calendering, wherein the coated web was stored in a machine reel prior to subsequent calendering. Correspondingly, the transport chain of paper from the mill to printing houses and other users has been speeded up, whereby the moisture even in uncalendered paper does not necessarily have enough time to stabilize and reach a sufficiently low level prior to printing. In coating, the web moisture content affects the penetration of water into the base web during the application of the coating mix and, as a result, the change of coating solids content after coating. As variations in the solids content of the coating are reflected in plural parameters in the application process, it is important to keep the web moisture during application and drying accurately within proper limit values in order to attain a uniform and desired final quality of the product.

Conventionally, a coated web is dried immediately after the application of coating using noncontacting dryers, which step may be followed when necessary by cylinder dryers and other dryers of the contacting type. The moisture content of the running web is measured at multiple points along the web travel in the coater apparatus and, on the basis of the measurement data, the drying effect of each dryer is individually adjusted so as to attain a proper web moisture over the cross-machine width at the respective measurement point as well as an average moisture content that stays between given limits during a run, the latter requirement meaning that the machine-direction moisture profile is controlled to a given set value. The overall drying capacity is adjusted to a suitable basic level based on test runs and data accumulated from a long-term experience in the art, and the individual dryer effects are then fine-tuned during the run on the basis of measurement data either automatically or manually. Conventionally, one of the dryers or one dryer group is selected to perform as the controller of the final moisture level, whereby the heating power input to the selected dryer group(s) is adjusted by means of a feedback signal obtained from the measurement system. In this arrangement, the other dryers are driven under manual control. Such a control scheme responds very tardy and compensation for the slow response of dryer control is difficult to implement in situations requiring a fast change of dryer effect levels. Furthermore, the web temperature prior to the coater apparatus must be kept sufficiently low to avoid floccing of the coating mix being applied. Hence, proper control of the drying effect is important particularly in the final stage of the dryer section prior to the subsequent coating step. The web temperature also affects the final quality of the coated web.

Particularly in situations of changing running conditions or when starting up the machine, known in the art as the run-up, the elevation of the dryer drying effect levels to correct values and adjustment of the same to proper run-time levels requires excellent skills from the personnel operating the machine. However, carrying out the procedure of setting the dryer evaporation effect levels in the coater section to correct values under run-up or changing process conditions takes time, during which the produced paper or board falls short of the specified quality requirements thus necessitating dumping of the web into the pulper. Hence, it is advantageous to minimize the durations of run-up and process value change times in order to achieve improved production efficiency at the machine. The above control scheme is also extremely clumsy in the optimization of drying energy consumption inasmuch it relies on the control of each dryer unit separately, whereby the mutual evaporation effect ratios between the dryer units are difficult to alter in an uncomplicated manner. Furthermore, a failure in one or a greater number of the dryer units is difficult to compensate for, because the process is designed for operation with all the dryer units being functional.

SUMMARY OF THE INVENTION

It is an object of the present invention to provide a method suited for controlling the machine direction moisture profile of a web to be coated in a manner optimized to respond to any moisture changes throughout the entire coating/drying process. In practice this approach means the application of a comprehensive control scheme covering all the dryer units of a coater section in an integrated manner in regard to energy consumption and product quality in order to attain an optimal end result.

The goal of the invention is achieved by way of forming a mathematical submodel of specific moisture evaporation rate for each process section and device contributing to the web drying process and then chaining the thus obtained individual submodels so as to form a composite model of the overall process, the model being suited for managing the drying phenomena during the entire process so that each individual unit of the equipment layout is controlled as a part of the overall process.

The invention offers significant benefits.

By virtue of the model according to the invention, it is possible to directly compute the moisture content of the web at the outgoing side of each dryer, provided that the specific evaporation rate at the dryer and the web moisture at the ingoing side are known. After the chaining of the individual submodels, the web moisture content can be computed at different points along the coater section, the most important parameter value obviously being the final moisture content of the web. With the help of the model, the dryer effects may be adjusted according to the individual properties so that the characteristics of different types of dryers are optimally taken into account. Since infrared dryers feature a quick response, they may be used, e.g., during run-up for controlling the overall effect of the dryer group, thus allowing the evaporation effect levels of other dryers to be elevated in a more relaxed manner to their steady-state values during the normal run by way of compensating for the delay of dryer warm-up with the help of delay terms adapted into the model. The use of delay terms also makes it possible to manage actual process response delays.

Since the invention provides a control scheme for the overall process, it allows the evaporation effects of the dryer units to be divided therebetween in a desired manner and, particularly in the case of failure in one dryer, the drying effect lost thereby may be compensated for by the other dryer units thus permitting operation of the coater section uninterrupted by a servicing shutdown. Equally, as the initial moisture content of the web as well as the amount of moisture added thereto by the applied coating are known, the model gives tools for computing an estimate for the web moisture at different points along the process and, particularly, prior to upwinding. In fact, the model allows the web final moisture content to be computed so accurately that production may be continued controlled by the model even when the moisture measurement devices are down.

The overall performance offered by the invention gives a faster and more accurate control result than that available by way of manual control combined with feedback loops controlling the individual drying units.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following, the invention will be examined in greater detail by making reference to the appended drawings in which.

DETAILED DESCRIPTION OF THE PRESENTLY PREFERRED EMBODIMENT

Figure 1:
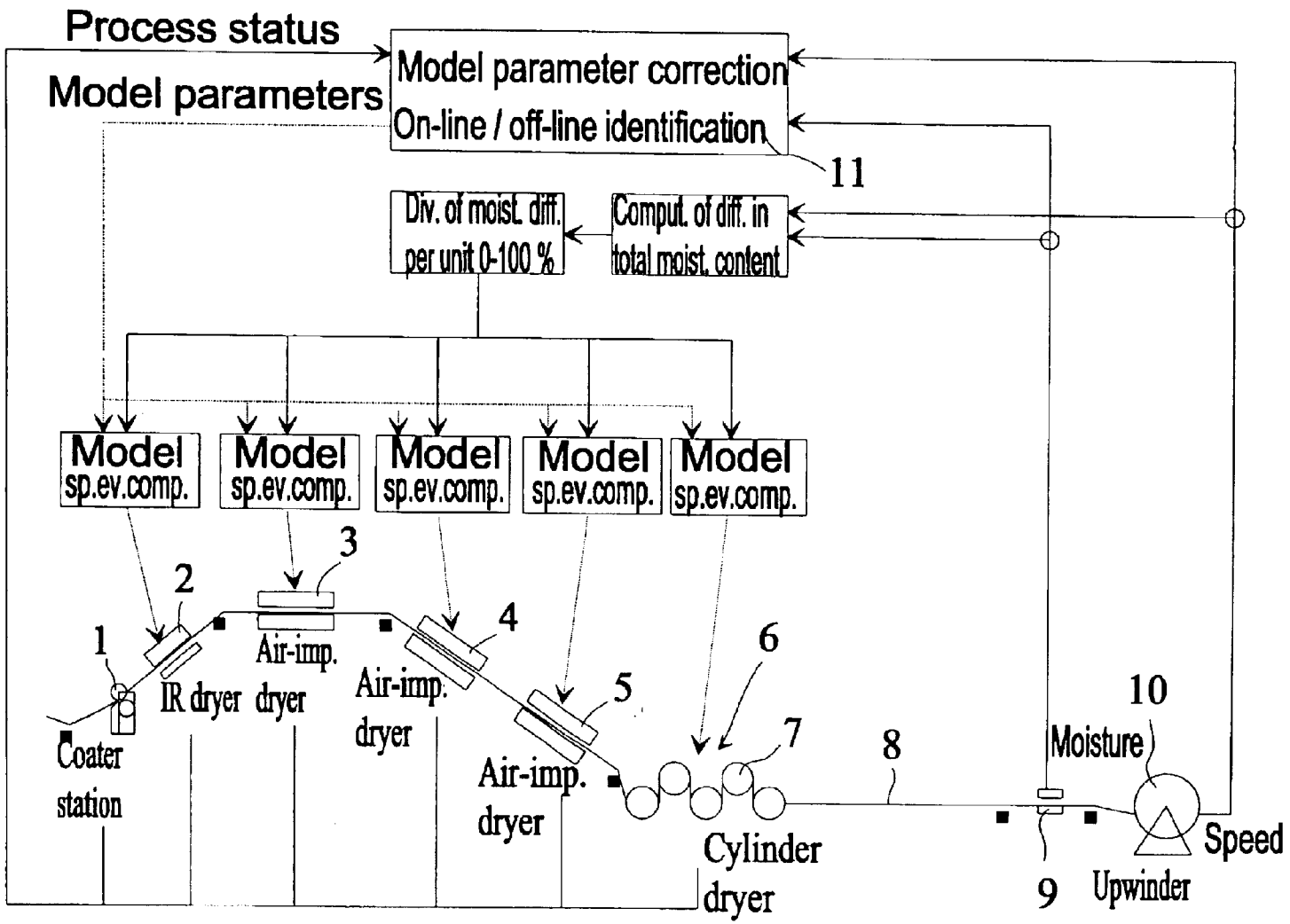
FIG. 1 shows a coater section or a portion thereof comprising one coater station and dryers.

Referring to FIG. 1, the diagram shown therein schematically illustrates a layout comprising one coater station 1 with dryers 2–6 connected thereto, whereby the functions related to the drying effect control of the dryers 2–6 are illustrated as a block diagram. In the downstream travel direction of a web 8, the first unit is a coater station 1 serving to apply coating or other web treatment substance such as surface size to at least one side of the web. As the type of coater station used is irrelevant to the implementation of the invention, the coater may be any suitable applicator apparatus such as a short-dwell coater, film-transfer coater, blade coater or spray coater. The coater station may be used for applying the coating to one side of the web 6 only as is customary, or to both sides, as required. Obviously, the construction of dryers 2–6 is dependent on whether two-sided or one-sided coating is performed in a single coater station, but nevertheless the function of any one of the dryers may be modeled in the same fashion in accordance with the invention.

Next downstream to the coater station 1 are located first an infrared radiant dryer 2, then three air-impingement dryers 3 to 5 and finally a dryer cylinder group 6 comprising a plurality of dryer cylinders 7. On the dryer cylinder group 6, the web 8 is dried to a moisture suitable for final calendering and next the web 8 is passed via a moisture content gauge 9 to the upwinder 10.

The process is controlled by means of a computer. The actual implementation of the computer may comprise a module running under the software of the coater section control computer, or a separately allocated computer or microprocessor serving the moisture control task alone or a physically distributed software and database package. The control system contains an evaporation rate submodel for each one of the dryers and a composite evaporation rate model compiled from these submodels. Additionally, the data base 11 of the control system serves to store the process status data, that is, the real-time status of both the coater section and the model obtained by way of measurement or directly from the computational data submitted by control system of the coater section. The status data includes such parameter values as the coater section status comprising the applied coat weight, solids content thereof and other similar factors, dryer evaporation effect levels, the final moisture content after the dryer units and the web speed as measured at the upwinder 10.

Figure 2:
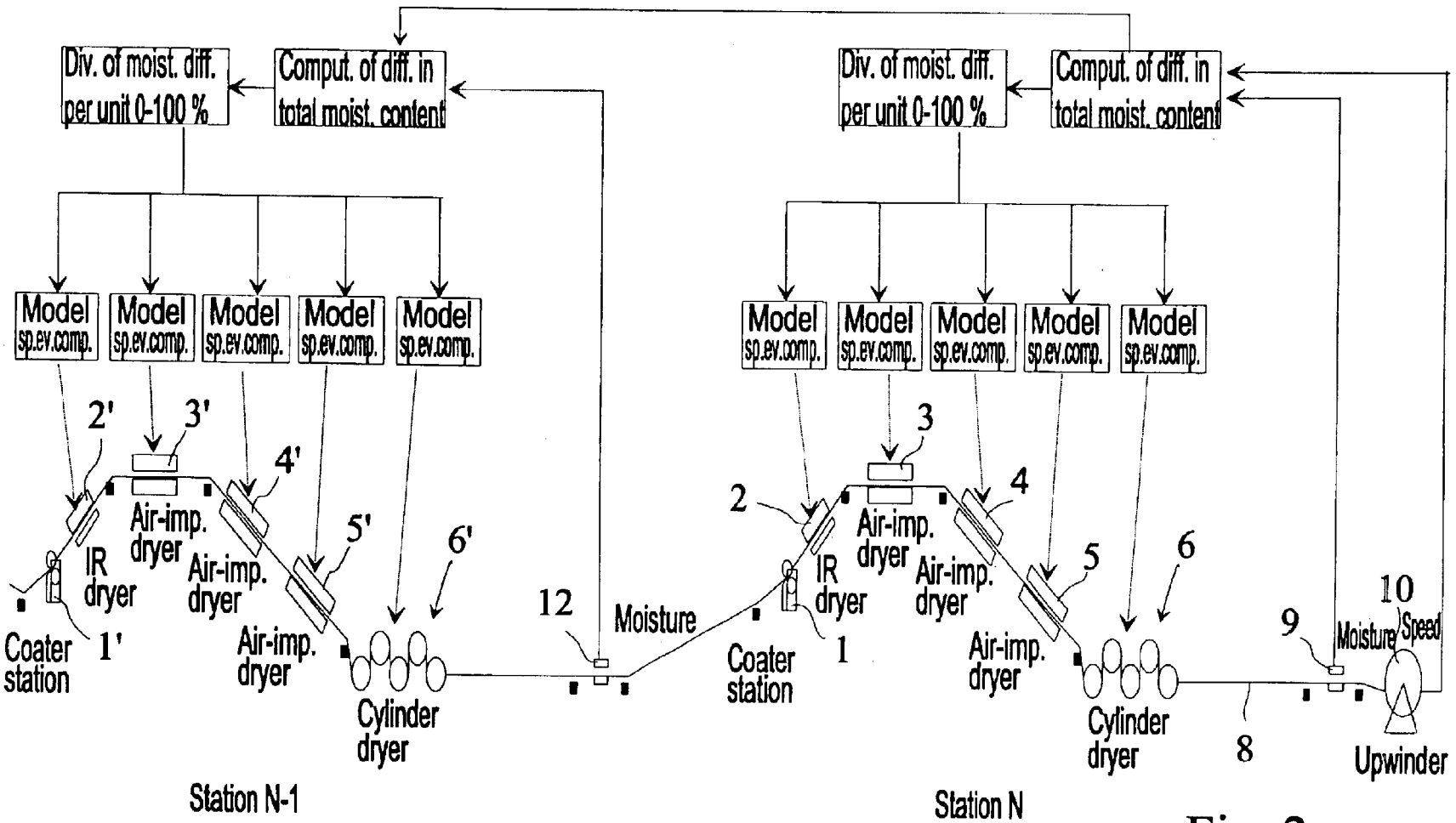
FIG. 2 shows a coater section or a portion thereof comprising two coater stations, each equipped with separate dryers.

In FIG. 2 is shown a system comprising two coater stations, each equipped with separate dryers. While the exemplifying embodiment is described below for the two last coater stations of a system, a complete layout may include a plurality of such subsystems formed by a coater station with dryers. Then, each subsystem may be described by means of an individual evaporation rate submodel, or more advantageously, a single model is compiled for the entire coater section, thus achieving a simpler control scheme for managing the overall process. In certain cases, particularly the web moisture prior to its entry into a successive coating step may exceed the final moisture content of the web, which means that the average moisture content of the web when passing through the coater section is higher than when the web reaches the upwinder. This kind of situation requires more drying effect after the last coater station than on the preceding stations, which is easy to arrange by virtue of the method according to the invention so that the computed or measured web moisture content value from the output of a next successive subsystem is fed back to the evaporation effect computation of the preceding subsystem. Conventionally, the moisture of web passed from the papermaking machine to the coater is in the range of about 1.5–4%, while the moisture of a treated web in the order of 4–6%. The moisture content values of the web may vary widely during the different phases of web treatment, and also the final and initial moisture contents of the web may vary according to the grade being manufactured. If desired, the initial moisture content of the web may be computed on the basis of the amount of evaporation during a run, this value being obtained from the model, and the final moisture content of the web, this value being measured prior to the upwinder.

Accordingly, the method according to the invention aims to provide an accurate overall control of the machine direction moisture profile of the web along its entire downstream travel through the coater section in all production situations and, particularly, during the dynamic transition phase toward the steady-state production run condition, that is, during machine run-up and when changes occur in the machine speed or the coating process parameters. The present method is capable of controlling a plurality of coater section dryers simultaneously so that the target value of web moisture is attained optimally. In the novel approach according to the invention, each drying unit is formulated with the help of a mathematical submodel describing the specific evaporation behavior of the unit, whereupon the submodel is utilized in the comprehensive control strategy for computing the unit-specific set values. The thus formulated specific evaporation rate models are used in a chained manner for modeling the overall process, complemented with certain measurement results obtained from the process. The parameters of the mathematical modeling equations may be updated on either per unit or per operating point basis using either off-line or on-line techniques. The thus obtained computational model can be brought to match exactly with the operation of the coater section for different kinds of manufactured product grades and varying process conditions.

The method can be applied to both so-called off-machine and on-machine coater sections, and it is capable of performing dryer control functions under a normal steady-state production run situation as well as during dynamic transition phases toward a normal production run state. In the context of the present invention, a normal steady-state production run situation is understood to refer to a condition in which no changes occur in the machine speed or, if changes do occur, they are of a type that will not be reflected in the product quality. Such change and transition situation(s) is/are represented by changes in machine speed and start-up of section operation. The measurements values of the process quality monitoring system and other values such as the web moisture, basis weight, coat weight, coat solids content and web temperature sensor signals obtained from the coater section control system serve as the input signals of the method. The measurement sensors of the process quality monitoring system may be located either after the last dryer unit in each coater station and preceding the upwinder, whereby the measurement system represents a comprehensive implementation or a portion of the so-called intermediate points of moisture measurement can be omitted, whereby the method may use the web moisture estimates which are computed from the evaporation model and bear an accurate relationship with the actual situation along the web travel, particularly when the parameters of the modeling equation are updated in real time.

Based on the mathematical models, the present method computes the specific evaporation rate, e.g., as $kgH_2O/m^2/h$ for each dryer or process unit contributing to the drying process. The computations take into account the coater stations, infrared radiant dryers, air-impingement dryers, cylinder dryers and other dryers associated with the coater section, as well as the open draws between the dryer units. Open draws form an important part of the modeling task and must be included in the composite model, because moisture evaporation also takes place on these portions of the web travel from the hot web exiting the dryers.

On a coater station, the coating applied to the surface of the web carries along a certain amount of excess water that must be removed on the dryers. When the initial moisture content of the web, as well as the amount of applied coating and the moisture content of the coating are known, it is possible on the basis of the web speed to compute the required overall evaporation effect and to divide it between the different dryers. The goal is to control the so-called intermediate moisture of the web after each coater station, as well the final moisture of the finished product to desired target values by means of steering the coater section dryers as an integrated system. The specific evaporation computation utilizes measurement data gathered on web moisture, temperature, speed and on the ambient air humidity. With the help of the specific evaporation models, it is possible to compute an estimate for the moisture of the web leaving any dryer. Similarly, it is possible to compute the change in web temperature within each process unit and the exit temperature of the web at the outgoing side of each unit. A chained composite model for the entire system is obtained by combining the mathematical submodel equations that describe the behavior of the dryers and the open draws. Herein, the values of the web moisture and temperature computed for the outgoing side of a preceding dryer are used as the input values for the next dryer, that is, representing the moisture and temperature values of the entering web.

According to the method, the web intermediate moisture after each coater station and the final moisture content of the finished product at the upwinder are controlled by means of specific evaporation submodels developed for the dryers of the coater section. With the help of these submodels it is possible to compute such set values of adjustment and control variables for each modeled unit that bring about the desired values of web intermediate and final moisture contents. The same approach also is used to manage a machine speed change situation. The control actions are carried out with the help of both closed-loop feedback circuits and feedforward circuits. Moisture measurement signals obtained from the process quality monitoring system are taken to the feedback circuit that adjusts the set values of one or more dryer units in the coater section. The feedforward circuit, which is employed to manage the dynamic transition states of machine speed change, uses set value estimates which are computed from the mathematical submodels of the specific evaporation rates for the final condition of the machine speed change state. This description, however, omits the details of the actual modeling techniques used inasmuch those skilled in the art have no difficulty in finding the needed mathematical tools in the literature.

The first step in the method according to the invention is to compute the specific evaporation rates for the different units of the production line. The specific evaporation rates as $kgH_2O/m^2/h$ are computed for the separate dryers of the coater section using the computational facilities of the automation system of the production line or of a separate computing unit intimately communicating therewith. The mathematical submodels of the coater section dryers are developed separately for the coater stations, infrared radiant dryers, air-impingement dryers and cylinder dryers and other dryers possibly cooperating with the coater section, and for the open draws. The mathematical submodels take into account the contribution of the characteristic control parameters of each unit and the effect of process variables on the overall specific evaporation rate. Such contributing variables include the web speed, the web initial moisture and temperature, the web basis weight, the coat weight, the solids content and composition of applied coating, air humidity, the lineal effect (kW/m) of the infrared radiant dryer, the temperature and flow rate of impinging air blown in the air-impingement dryer, and the steam pressure and flow rate in cylinder dryers. As an outcome of the computation, the submodels give the specific evaporation rate for each dryer, the web moisture at the outgoing side of the dryer and the web temperature at a given point of interest when properly selected control variables are used in the equations.

With the help of data obtained from the process quality monitoring system, the characteristic parameters of the evaporation rate submodels may be corrected, e.g., as per paper grade and system operating status. In this fashion, the composite model can be tuned to accurately match the actual operating status and the behavior of the coater section to be controlled. To this end, the estimate obtained from the model for the web moisture at a given point of the web travel, e.g., prior to upwinding, is compared with the actual moisture data obtained from the web measurement sensors. On the basis of this comparison, an error term is computed for the model that is then used in the correction computation for the model parameters. The correction computation may be carried out as either an off-line task within the automation system of the production line or other computing system connected thereto or alternatively, directly as an on-line task in the automation system, using appropriate computing routines such as the least squares method, for instance, or equivalent recursive algorithms. For this purpose, the dryers are controlled according to a specific strategy so that all the dryers are set to a constant evaporation effect state, with the exception of the one for which the equation parameters of the submodel are to be analyzed. During the parameter value update operation, the control signals of the dryer being analyzed are appropriately varied in accordance with the parameter identification technique used, e.g., by way of imposing stepwise changes in the set value or superimposing a PRBS (pseudo-random binary signal) on the set value output signals in order to cause a sufficient amount of changes in the system being analyzed so that the computational algorithm of the parameter identification technique will converge. The thus obtained parameter values of the modeling equations as per paper grade and process operating point can be stored in a separate database or in the grade-specific production control files of the process automation system.

According to the invention, moisture control along the downstream travel of the web takes place as follows. In the method described herein, a model-based web moisture controller computes from the actual measurement signal of the web moisture and the target value of the web moisture a control signal, whereby the computational process utilizes a composite model compiled from the mathematical submodels of the individual dryers. The computation takes into account the specific evaporation rates of the dryers and the prevailing manufacturing process conditions. With the help of the submodels, such set values of adjustment and control variables are computed for each dryer separately that are required to attain the desired intermediate and final values of web moisture. During dynamic changes of machine speed, the control algorithm computes the need for effect change in the dryers according to the change in web speed.

In a normal steady-state production run situation involving no change in web speed, a feedback-type control scheme is used, whereby the model input signals formed by the web moisture set value and the actual web moisture measurement information are processed into a feedback signal of moisture error, on the basis of which signal the control algorithm then performs required changes to an extent defined by the system operator in the drying effects of dryers selected to be controlled by the control computer. While all the dryers may be set to be controlled by a computer or, respectively, set for manual control, in the spirit of the invention the drying effect of at least one dryer must be steerable by means of a model running on a computer. Herein, as shown in FIG. 2, either the intermediate point moisture sensor 12 or the process quality monitoring system sensor 9 preceding the upwinder 10 give the actual web moisture content value that is compared by the control program with the set value. On the basis of the difference between the set value and actually measured web moisture, the system computes the respective change of the overall moisture ($\Delta H_2O$) that should be accomplished by means of the dryers selected to be steered by the control computer. If the moisture difference signal has a positive sign, the specific evaporation rate must be increased. Respectively, a negative sign indicates a need for reduced specific evaporation rate. The overall value of required moisture change (A $H_2O$) is divided between the dryers (i=1–N) selected to be steered under computer control using such proportional percentage weight factors (0–100%) that the sum of the weighting factors always is 100%. Obviously, other weighting strategies are also possible in the division of moisture change, that is, to implement the required change in the distribution of the drying effect between the dryers. For instance, the weighting factors may be selected to be proportional to the available evaporation rate capacities on the modeled dryers or to the desired moisture values at the intermediate points. In this kind of proportional division, each of the selected dryers is allocated to handle so much of the overall moisture difference control task as is indicated by its weighting factor. The specific evaporation rate models are then used for computing the required changes in the set values of control signals given to each one of the selected dryers. After computation, the new set values are transmitted to the unit controllers that implement the changes in the set values.

Figure 3:
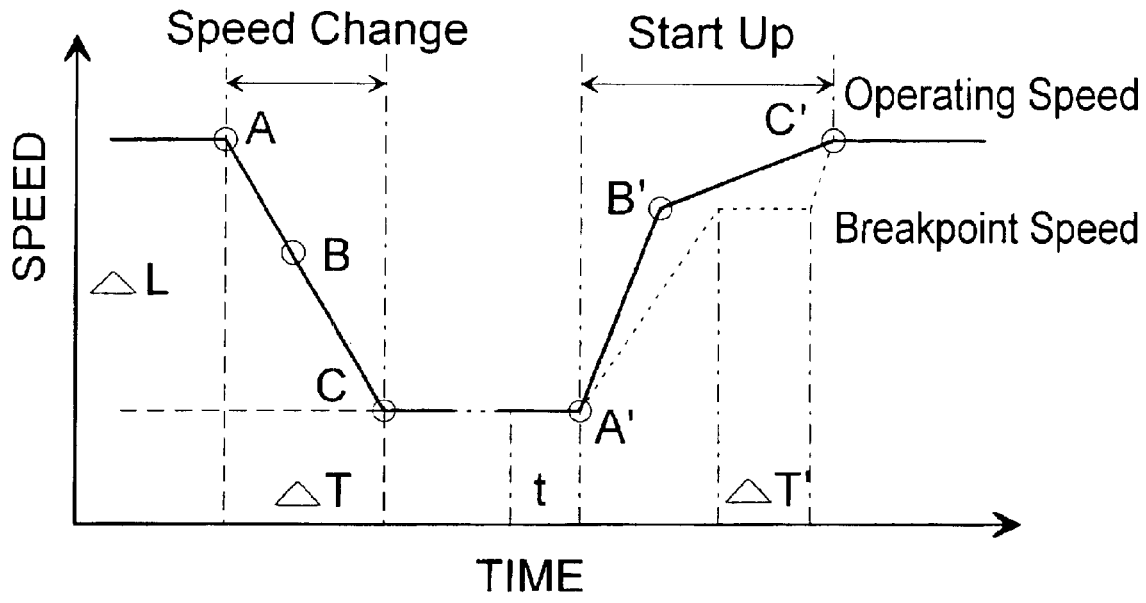
FIG. 3 shows a schematic plot of changing web speed in the coater section.
Figure 4:
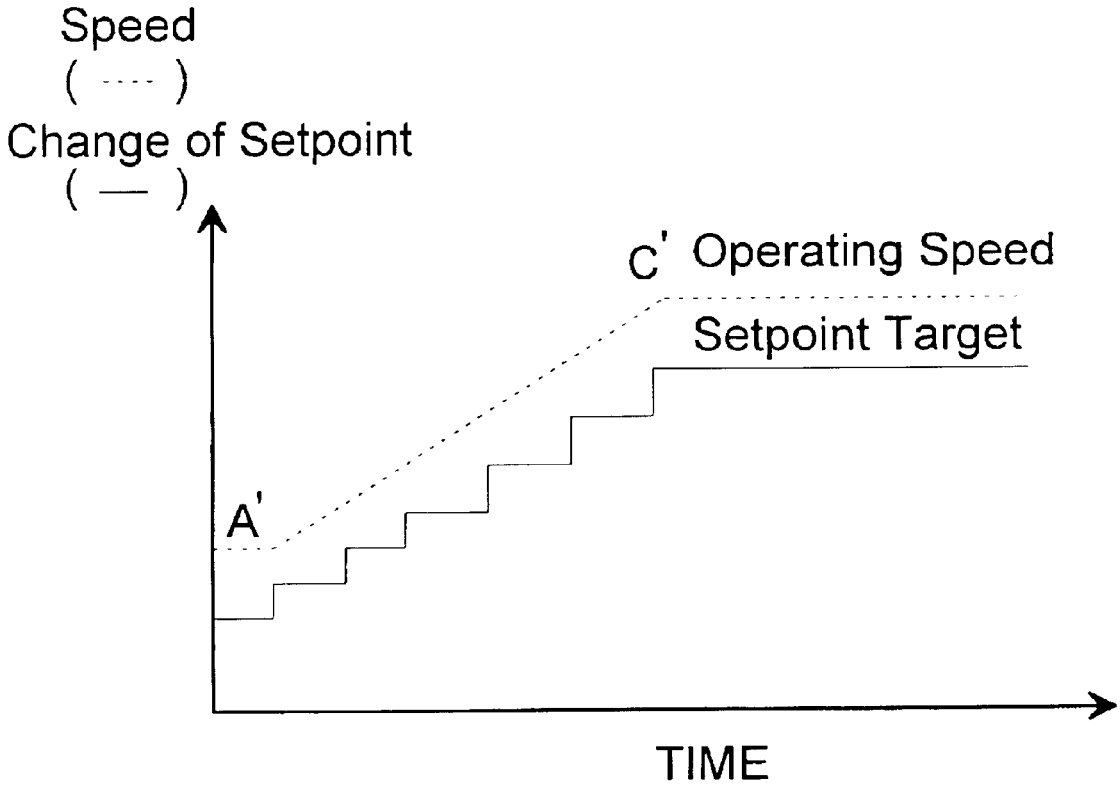
FIG. 4 shows a schematic plot of the control of the dryer effect at a change in the web speed.

In FIG. 3 is shown a situation involving a change in the machine speed. In this case, the control scheme relies on a feedforward circuit. To perform a change in the machine speed from point A of the diagram to point C, the procedure goes as follows. The new set values required at point C for the dryers of the coater section are computed at point A using the submodel equations so that the correction to be made in the set values due to the machine speed change are taken into account. The new set values can be transmitted to the unit controllers either immediately at the start of the machine speed change (point A) or incrementally over the entire duration of the machine speed change phase as shown in the diagram of FIG. 4. The choice of either control strategy is dictated by the amount of machine speed change ($\Delta L$), duration of the change ($\Delta T$) and the dynamic behavior of the selected dryer. During machine run-up, the control strategy can be, e.g., as shown in the right-hand plot of FIG. 3. The new set values required for the unit controllers at either point B' or point C' are computed at point A' with the help of the modeling equations. If the acceleration of the machine takes place via an intermediate point B', the corresponding set values for the target speed at point C' can be transmitted at either points A', B' or in an incrementally stepwise manner (see FIG. 4). For controlling such fast-response dryers as infrared radiant dryers, a desired number of incremental point values may be computed on the basis of the set value start and end points, whereby the incremental values are activated when the machine attains a speed corresponding a given set value. On the other hand, if the slow dynamic response at, e.g., air-impingement dryers and cylinder dryers (characterized by a delay time t) is taken into account, the set values corresponding to point C' for the selected units may be transmitted already at point (A'−t) or the delayed response may compensated for in the incremental control. The intermediate point B' is most conventionally used, e.g., for shutting down the coater stations. Herein, depending on the time span (ΔT'), it is possible to compute also for point B' the set values of the unit controllers that are then used as the input values in the computation of variable set values for transition toward state C'. The method can also handle situations in which full-width moisture measurement information obtained from the product quality monitoring system or partial-width moisture profile measurements are utilized during machine speed changes or system run-up. In a partial-width moisture profile measurement, the moisture sensor of the product quality monitoring system may be of a so-called fixed type (nontraversing) or the sensor may be arranged to perform a traversing movement, that is, in the cross-machine direction, only for a partial width of the web covering the web by 0.5–1.0 m, for instance. In this case the arrival of a new, reliable moisture measurement value always triggers a corrective action performed with the help of the modeling equations or other correction computation on the estimates of set values transmitted to the dryers.

Figure 5:
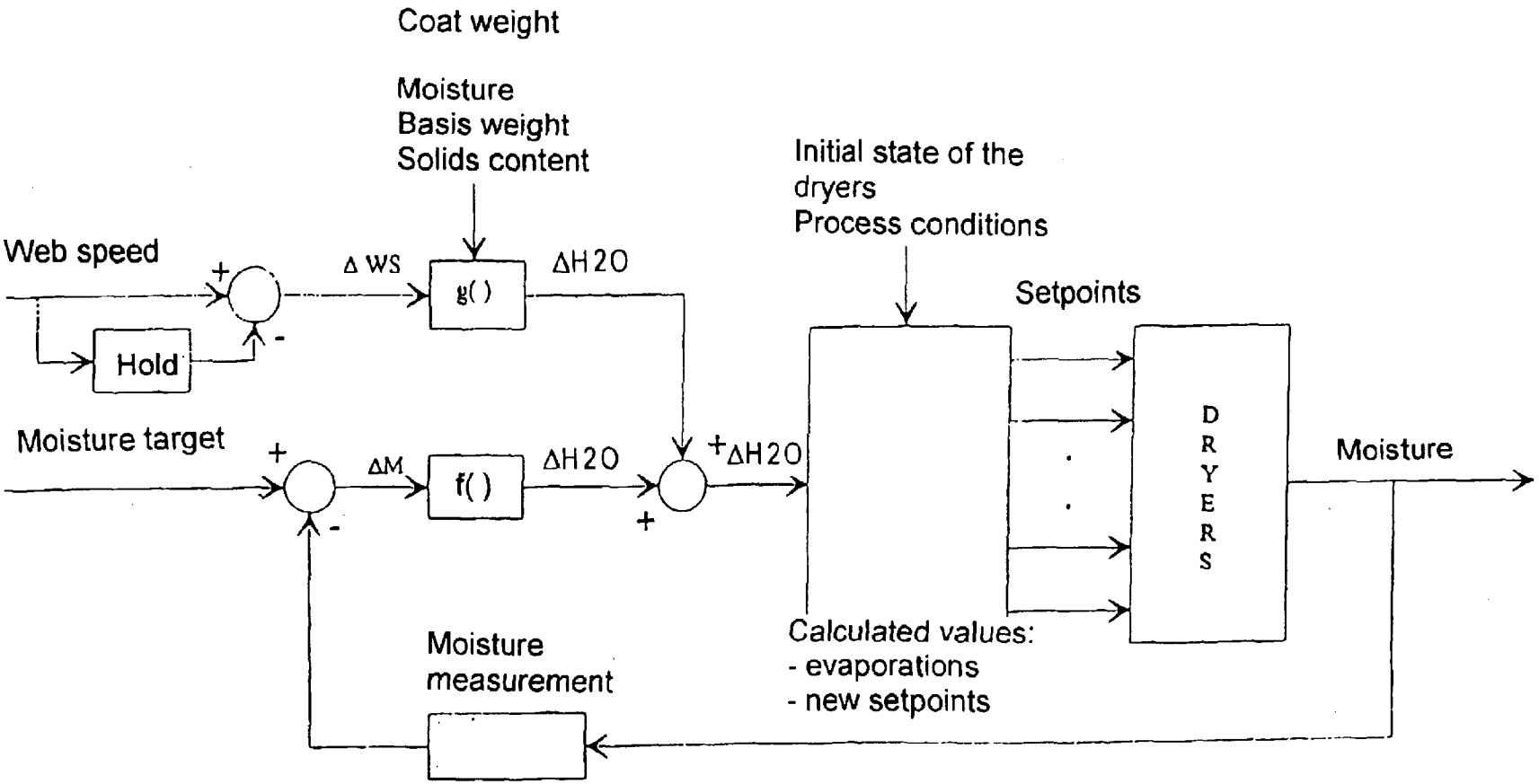
FIG. 5 shows block diagram of the present control method.

In FIG. 5 is shown the above-described control strategy in a slightly different diagram. The control scheme illustrated in this block diagram is equivalent to that shown in FIGS. 1 and 2. The left-hand part of the diagram depicts the determination of the moisture difference value. To this end, the first step is to measure the web speed, whereupon it is possible to employ the data on coat thickness, moisture, base web basis weigh and coat solids content in the determination of the web moisture or change of moisture $\Delta H_2O$ at the ingoing side of a dryer. When the moisture set value is summed with the measured value, or the actual value, of web moisture, the result is the difference ΔM between the set value and the actual value, wherefrom is possible to compute the needed drying effect change $\Delta H_2O$ that must be summed with other possible changes caused by process deviations. On the basis of the thus obtained need for drying effect change, the needed drying effects and new dryer set values are computed with the help of the composite model of the process and the actual values of process conditions and process status. After computation, the new set values are transmitted to the dryers.

The method according to the invention can be applied to all kinds of paper/board coating techniques and equipment in which the surface of a base web is coated with a liquid-based that is dried on at least one dryer. Generally, however, the layout comprises plural dryers and, in fact, the benefits of the invention will be the greater the more complicated the coater section is.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling a drying effect of an equipment layout used in making a coated web of paper or board, the equipment layout comprising at least one coater unit and a plurality of drying units, the method comprising:

applying a liquid-containing coating to a surface of a web in the at least one coater unit;

drying the web coated with the coating in the plurality of drying units by evaporating the liquid from the coated web until a moisture content of the web reaches a desired final moisture value;

compiling, for each drying unit wherein moisture is evaporated from the web, an evaporation rate submodel suited for computing an amount of liquid removed by the respective drying unit, wherein at least one specific evaporation rate submodel is linked into a composite evaporation rate model;

determining a needed overall evaporation effect to be performed by the equipment layout to achieve the desired final moisture value;

determining, by employing the composite evaporation rate model, a needed moisture evaporation effect for each drying unit of the equipment layout having an evaporation rate submodel linked into the composite rate model to achieve the needed overall evaporation effect; and controlling the moisture evaporation rate for each drying unit of the equipment layout having an evaporation rate submodel linked into the composite rate model, the moisture evaporation rate being controlled in accordance with the determined needed moisture evaporation effect without measuring an actual amount of liquid removed by any individual drying unit of the equipment layout while such drying unit is drying the web.

2. The method according to claim 1, further comprising:

controlling an evaporation effect of one drying unit of the equipment layout having an evaporation rate submodel linked into the composite rate model with the composite evaporation rate model; and setting the evaporation effect of every other drying unit of the equipment layout to a fixed value.

3. The method according to claim 2, wherein a control signal to the controlled drying unit is changed in at least one of a stepwise manner and a superimposition of a pseudo-random binary signal (PRBS) on at least one set value.

4. The method according to claim 1, further comprising:

measuring a final moisture content of the web attained after drying the web with the drying units of the equipment layout;

comparing the measured final moisture content with the desired final moisture value; and controlling the moisture evaporation rate for at least one drying unit of the equipment layout with the composite evaporation rate model based upon the comparison of the measured final moisture content with the desired final moisture value.

5. The method according to claim 1, wherein any needed change in the overall moisture evaporation effect is allocated among drying units for which the evaporation rate is controlled using the composite evaporation rate model proportionately in ratios determined by predetermined weighting factors.

6. The method according to claim 1, further comprising:

measuring an initial moisture content of the web prior to entering a first of the at least one coater unit;

determining the amount of liquid applied to the web in said applying step; and controlling, using the composite evaporation rate model, the measured initial moisture content and the determined amount of liquid applied to the web, an evaporation rate of at least one controllable drying unit of the equipment layout.

7. The method according to claim 1, wherein an output value obtained from the evaporation rate submodel of a drying unit of the equipment layout is used as an input value in the evaporation rate submodel of a next successive drying unit of the equipment layout.

8. The method according to claim 1, wherein an output value obtained from the evaporation rate submodel of a unit of the equipment layout is used as input value in the evaporation rate submodel of a preceding unit of the equipment layout.

9. The method according to claim 1, wherein the equipment layout comprises a plurality of subsystems, each subsystem comprising at least one coater unit and at least one dryer unit, and wherein an output value obtained from the evaporation rate submodel of a subsystem is used as input value in the evaporation rate submodel of a preceding subsystem.

10. The method according to claim 1, wherein the equipment layout comprises a plurality of subsystems, each subsystem comprising at least one coater unit and at least one dryer unit, and each subsystem having a respective evaporation rate submodel, and wherein the subsystem evaporation rate submodels interact to produce the needed overall moisture effect of the equipment layout.

11. A method for controlling the drying of a coated web of paper and/or board in a web apparatus comprised of at least one coater, at least one dryer, and at least one open draw after at least one dryer, the method comprising the step of:

using a composite drying effect model of the overall drying effect of the web apparatus to control the drying of the coated web, said composite drying effect model being comprised of a plurality of drying effect submodels linked together;

wherein each of the at least one coater, the at least one dryer, and the at least one open draw has a drying effect submodel of its drying effect on the coated web included in the plurality of drying effect submodels comprising the composite drying effect model;

wherein an output of each submodel comprises an evaporation rate of the component represented by said submodel, a moisture value of the web output from the component represented by said submodel, a change in web temperature within the component represented by said submodel, and/or a temperature of the web output by the component represented by said submodel; and wherein an output of at least one submodel in the composite drying effect model comprises an input of a submodel following said at least one submodel in the composite drying effect model.

12. The method according to claim 11, wherein the step of using a composite drying effect model of the overall drying effect of the web apparatus to control the drying of the coated web comprises the sub-step of:

complementing the composite drying effect model with measurement results from the web apparatus.

13. The method according to claim 11, wherein submodels for individual components are combined together to form composite submodels.

14. The method according to claim 13, wherein the web apparatus comprises at least two coating stations, each of the at least two coating stations comprising at least one coater and at least one dryer, and wherein submodels for individual components in each of the at least two coating stations of the web apparatus are combined together to form a composite submodel.

15. The method according to claim 14, wherein the step of using a composite drying effect model of the overall drying effect of the web apparatus to control the drying of the coated web comprises the sub-step of:

using a feedback system with a coating station composite submodel to adjust set values of one or more of the at least one dryer in the coating station using moisture measurements from the output web of the coating section.

16. The method according to claim 14, wherein the step of using a composite drying effect model of the overall drying effect of the web apparatus to control the drying of the coated web comprises the sub-step of:

using a feedforward system with a coating station composite submodel to manage dynamic transition states during web speed changes.

17. The method according to claim 13, wherein an output of a composite submodel is fed back as input to a previous composite submodel in the chain forming the composite drying effect model.

18. The method according to claim 11, further comprising the step of:

using the composite drying effect model to calculate an initial moisture content and/or intermediate moisture content of the web using a measurement of the final moisture content of the web.

19. The method according to claim 11, further comprising the step of:

using the composite drying effect model to calculate a final moisture content of the web using a measurement of an initial moisture content and/or intermediate moisture content of the web.

20. The method according to claim 11, wherein each submodel is of a drying effect on the coated web by a component comprising the web apparatus, and wherein the step of using a composite drying effect model of the overall drying effect of the web apparatus to control the drying of the coated web comprises the sub-step of:

taking into account, for each submodel, the contribution of characteristic control parameters of its corresponding component and the effect of process variables on the overall drying effect of the web apparatus.

* * * * *